US005842759A

United States Patent [19]

Ferrari et al.

[11] Patent Number: 5,842,759

[45] Date of Patent: Dec. 1, 1998

[54] DEVICE FOR ADJUSTABLY FITTING A DRAWER RUNNER ON A FURNITURE UNIT

[75] Inventors: Franco Ferrari, Località Deviscio, 2, 23900 Lecco, Italy; Carlo Migli, Lecco, Italy

[73] Assignee: Franco Ferrari, Italy

[21] Appl. No.: 9,565

[22] Filed: Jan. 20, 1998

[30] Foreign Application Priority Data

Jan. 24, 1997 [IT] Italy ..... MI970038 U

[51] Int. Cl.[6] ..... A47B 88/00

[52] U.S. Cl. ..... 312/334.5; 312/334.27; 248/298.1

[58] Field of Search ..... 312/334.5, 334.7, 312/348.2, 348.1; 248/221.11, 224.61, 224.8, 257, 265, 298.1; 16/94 R, 383

[56] References Cited

U.S. PATENT DOCUMENTS

| | | | |
|---|---|---|---|
| 2,698,214 | 12/1954 | Samser | 312/334.5 |
| 3,675,883 | 7/1972 | Holmes et al. | 312/334.5 |
| 3,750,993 | 8/1973 | Read | 312/334.5 |
| 4,244,546 | 1/1981 | Mertes et al. | 312/334.5 |
| 5,359,752 | 11/1994 | Domenig | 312/334.5 |

*Primary Examiner*—Peter M. Cuomo
*Assistant Examiner*—Gerald Anderson
*Attorney, Agent, or Firm*—Shlesinger, Fitzsimmons & Shlesinger

[57] ABSTRACT

A device (10) for adjustably fitting a drawer runner on a furniture unit, comprises a first plate (11) with fastening means (12) for securing it to the furniture unit, and a second plate (13) with fastening means (14) for securing it to the runner. The two plates comprise guides (17, 18) for reciprocal sliding constraint. An eccentric cam (20) is received in a first slot (19) in a plate and has a pivot (22) which is received in a second slot (21) in the other plate, thereby achieving the reciprocal sliding of the two plates parallelly to the guides constraining the manual rotation of the cam. The plate with the second slot (21) has a slanted plane (23) which extends in the sliding direction of the constraining guides (17, 18) and towards the second slot (21) to constitute sliding surfaces for the pivot (22) during the assembly of the two plates by reciprocal sliding along the constraining guides until the end of the pivot snaps into the second slot (21). After assembly, the pivot protrudes into the second slot (21) and prevents the disassembly of the plates (11, 13).

6 Claims, 2 Drawing Sheets

Tav. I

Tav. II

DEVICE FOR ADJUSTABLY FITTING A DRAWER RUNNER ON A FURNITURE UNIT

BACKGROUND OF THE INVENTION

This invention refers to a device for adjustably fitting drawer runners. In particular, the device allows the cam adjustment of the crosswise position of a runner for drawers fitted on a furniture unit. In the known technique, devices have been proposed for adjusting the crosswise position of runners, which are composed of a relatively large number of parts, comprising reciprocally sliding parts, assembling screws and reciprocal blockage of the parts, etc. Such devices are relatively expensive and require time and care for their correct assembly. The general scope of this invention is to obviate the problems of the known technique, by providing a device for adjustably fitting runners which is composed of a minimum number of parts and is quickly and easily assembled while having a sturdy structure and ensuring stable and precise adjustment.

SUMMARY OF THE INVENTION

This scope is achieved according to the invention by providing a device for adjustably fitting a runner for a drawer on a furniture unit, comprising a first plate bearing means for fastening the device on the furniture unit, and a second plate bearing means for fastening it to the runner, the two plates comprising reciprocally sliding constraining guides, an eccentric cam being received in a first slot in one of the two plates and having a pivot with an end which is received in a second slot in the other of the two plates, thereby achieving the reciprocal sliding of the two plates parallelly to the guides constraining the manual rotation of the cam, the plate having the second slot comprising a slanting plane which extends in the sliding direction of the constraining guides and towards said second slot to constitute sliding surfaces of said end of the pivot during assembly of the two plates by reciprocal sliding along the constraining guides until the end of the pivot snaps into the second slot, after assembly the pivot protruding into the second slot to prevent the disassembly of the two plates.

BRIEF DESCRIPTION OF THE DRAWINGS

The innovative principles of this invention and its advantages with respect to the known technique will be more clearly evident from the following description of a possible exemplificative and non-restrictive embodiment applying such principles, with reference to the accompanying drawings, in which.

DETAILED DESCRIPTION OF THE INVENTION

Figure 2:
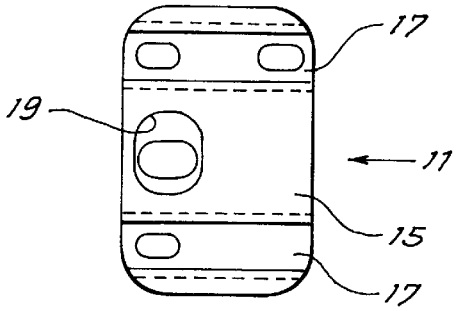
FIGS. 2 and 3 show plan views of a first and a second element forming the device.
Figure 3:
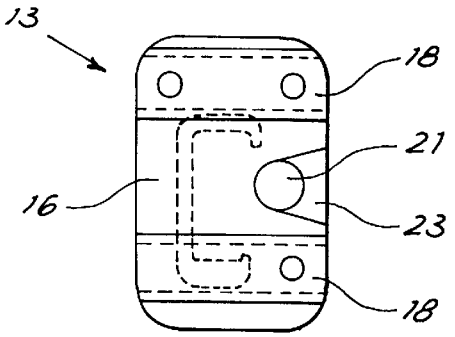
Figure 1:
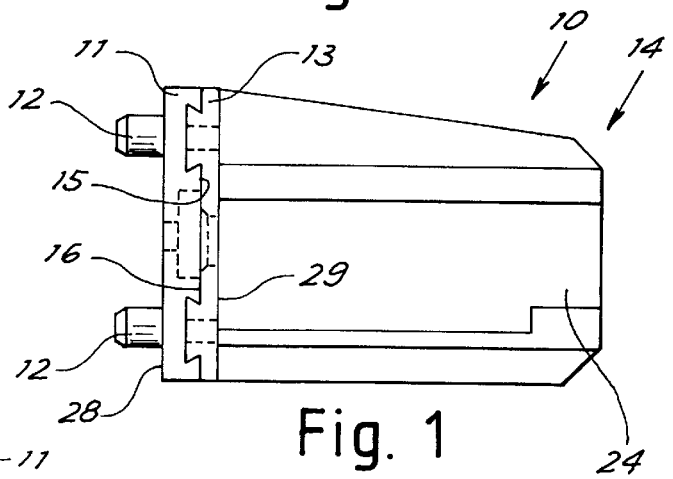
FIG. 1 shows a side view of a fitting and adjusting device according to the invention.

With reference to the figures, FIG. 1 shows a device, generically indicated by reference 10, for adjustably fitting a drawer runner on a furniture unit. The device comprises a first plate 11, which bears fastening means 12 for securing the device to the furniture unit, and a second plate 13 bearing fastening means 14 for securing it to the runner. The two plates face each other with respective faces 15, 16 and comprise reciprocal constraining guides sliding in a parallel plane. As can be clearly seen also in FIGS. 2 and 3, the sliding guides can advantageously be achieved by means of dovetail guides 17, 18 disposed on the opposing surfaces 15, 16 of the two plates.

The plate 11 comprises a slot 19 which faces onto the surface 15 between the guides 17 to receive an eccentric cam 20 which has a pivot 22. The slot 19 is shaped in such a way as to provide lateral bearing surfaces for the cam so as to achieve a cam adjustment parallel to the runners. The plate 13 comprises a second slot or hole 21 which, when the plates are assembled together, receives the pivot 22. The hole 21 is a through hole in the plate 13 to enable the manual rotation of the cam, for example by means of a screwdriver engaging a cross slot on the head of the pivot.

Figure 5:
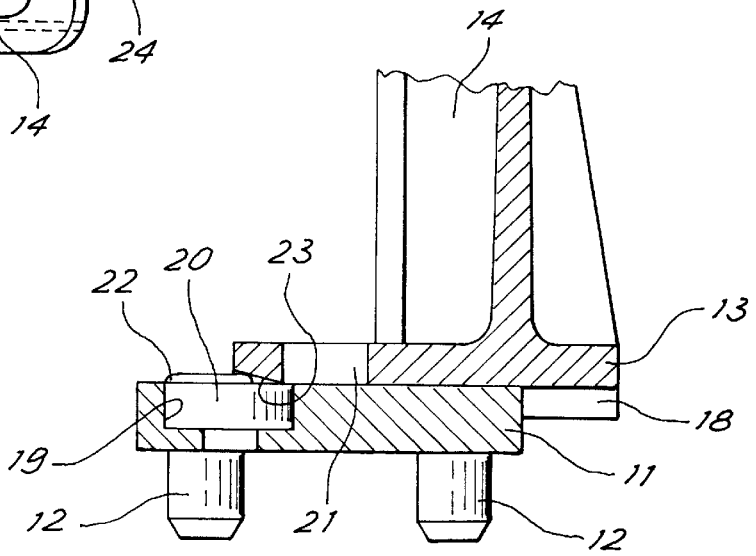
FIG. 5 shows a cutaway scrap view, along the line V—V of FIG. 4, of the device during a phase of its assembly.
Figure 6:
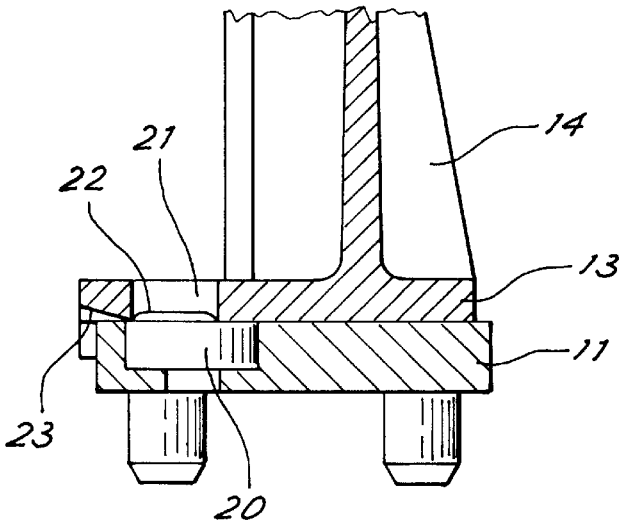
FIG. 6 is similar to FIG. 5, but shows the device after assembly.

According to the invention, the plate 13 has on the face 16 a slanting surface 23 which extends in the sliding direction of the constraining guides 18 and towards the slot 21. As can be clearly seen in FIG. 5, the slanting surface constitutes a sliding surface for the end of the pivot 22 during assembly of the two plates, which is achieved by reciprocal sliding of the plates along the constraining guides until the end of the pivot snaps into the second slot (FIG. 6). Thanks to the lead-in consisting of the slanting surfaces, which approaches the opposing surface of the other plate approaching the slot 21, the snap-fitting of the two plates is achieved by simply forcing them (for example, by striking the side of one of the two plates) from the position of FIG. 5 to the position of FIG. 6. This operation can be facilitated by a certain amount of flexibility of the plates, for example made of plastic material. Once the pivot 22 protrudes into the slot 21, the disassembly of the plates is efficaciously prevented.

Figure 4:
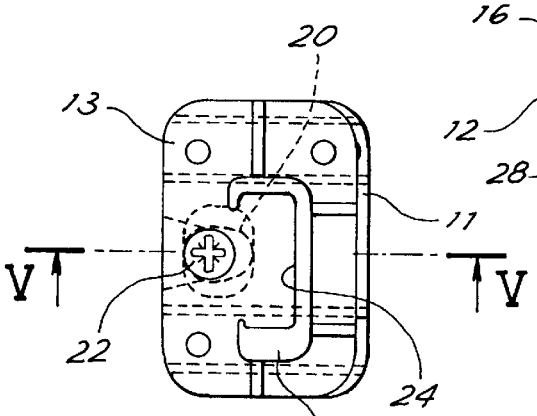
FIG. 4 shows a plan view of the two elements of FIGS. 2 and 3 assembled.

In FIG. 4 the cam is shown in a position of extreme adjustment which displays the possibilities of adjusting the device by the reciprocal sliding of the two plates parallel to the constraining guides when the cam is rotated manually.

In the embodiment shown, the fastening means for securing the device to the furniture unit are disposed on the face 28 of the first plate 11 facing the second plate and are made in the form of dowels protruding in a perpendicular direction from said face. The fastening means for securing it to the drawer runner are disposed on a face 29 of the second plate facing the first plate and comprising a shank 14, with an advantageously C-shaped cross-section, which protrudes in a direction perpendicular to the face of the plate to form a housing 24 to receive a leading end of a drawer runner disposed to extend perpendicular to the sliding direction of the guides 17, 18.

Figure 7:
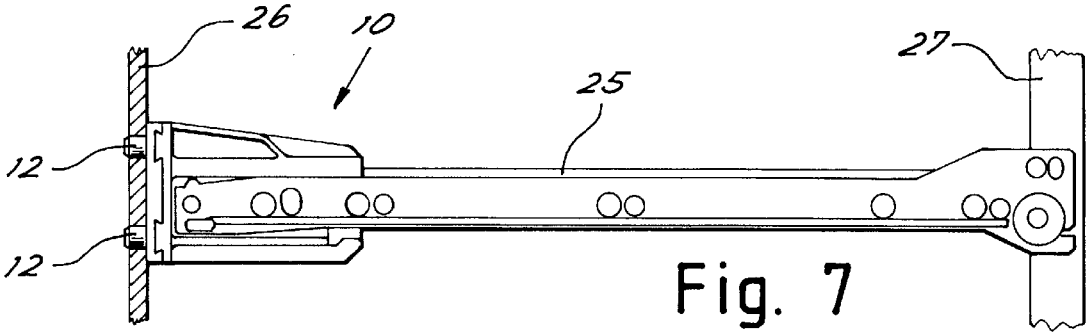
FIGS. 7 and 8 show schematic side and plan views, respectively, of a drawer runner fitted in a furniture unit by means of the device according to the invention.
Figure 8:
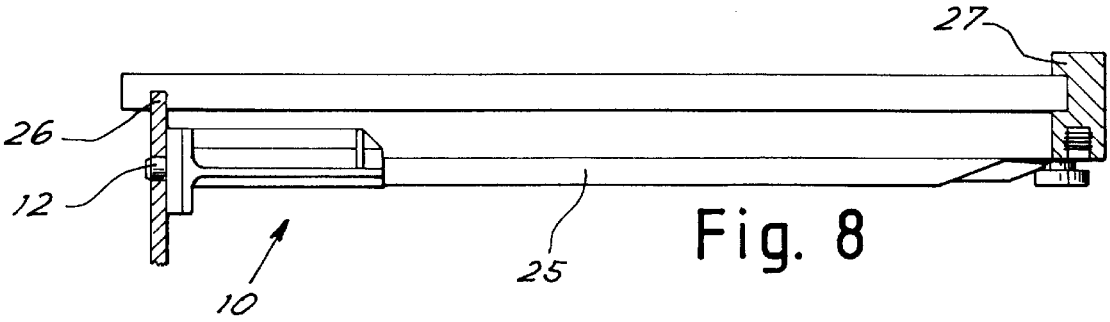

FIGS. 7 and 8 show the use of the device for fitting and adjusting a drawer runner, indicated by reference 25, in a furniture unit of the type referred to as a frame bearing structure, widely used in the United States.

As can be seen in the figures, the drawer runner 25 is posteriorly secured to the rear frame 27 of the furniture unit and is anteriorly inserted in the housing 24, while the dowels 12 are fitted into the front frame 26 of the furniture unit. Rotation of the cam thus allows the crosswise adjustment of the runner 25, in particular to adjust its paralellism with another opposing runner (not shown).

At this point it is clear that the intended scopes have been reached by providing an adjusting device composed of just three pieces, easily snap-fitted by exploiting the adjusting cam as a fitting means.

The foregoing description of an embodiment applying the innovative principles of this invention is obviously given by way of example in order to illustrate such innovative principles and should not therefore be understood as a limitation to the sphere of the invention claimed herein. For example, the slots 19, 21 can exchange places on the plates and the means securing the plates to the furniture unit and to the drawer runner can be made with a shape suitable for specific requirements. The guides between the plates can be made differently from the ones shown.

What is claimed is:

1. Device for adjustably fitting a drawer runner on a furniture unit, comprising a first plate bearing fastening means for securing the device to the furniture unit, and a second plate bearing fastening means for securing it to the runner, the two plates comprising guides for reciprocal sliding constraint, an eccentric cam being received in a first slot in one of the two plates and having a pivot with an end which is received in a second slot in the other of the two plates, thereby achieving the reciprocal sliding of the two plates parallelly to the guides constraining the manual rotation of the cam, the plate having the second slot comprising a slanted plane which extends in the sliding direction of the constraining guides and towards said second slot to constitute sliding surfaces for said end of the pivot during the assembly of the two plates by reciprocal sliding along the constraining guides until the end of the pivot snaps into the second slot, after the assembling, the pivot protruding into the second slot to prevent the disassembly of the two plates.

2. Fitting and adjusting device as claimed in claim 1, characterized in that the constraining guides are achieved by means of dovetails in surfaces of the two reciprocally facing plates.

3. Fitting and adjusting device as claimed in claim 1, characterized in that the fastening means for securing the device to the furniture unit are disposed on one face of the first plate opposite the second plate and that the fastening means securing it to the drawer runner are disposed on a face of the second plate facing the first plate.

4. Fitting and adjusting device as claimed in claim 3, characterized in that the fastening means securing the device to the furniture unit comprise dowels protruding in a perpendicular direction from said face of the first plate.

5. Fitting and adjusting device as claimed in claim 3, characterized in that the fastening means securing the device to the drawer runner comprise a shank protruding in a perpendicular direction from said face of the second plate to form a housing to receive a leading end of a drawer runner.

6. Fitting and adjusting device as claimed in claim 5, characterized in that said shank has a C-shaped cross-section.

* * * * *